US010152003B2

(12) United States Patent
Shimada et al.

(10) Patent No.: US 10,152,003 B2
(45) Date of Patent: Dec. 11, 2018

(54) IMAGE FORMING APPARATUS

(71) Applicant: FUJI XEROX CO., LTD., Tokyo (JP)

(72) Inventors: Yasuhiro Shimada, Kanagawa (JP); Tomoaki Yoshioka, Kanagawa (JP); Yoko Miyamoto, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/243,394

(22) Filed: Aug. 22, 2016

(65) Prior Publication Data

US 2017/0219967 A1 Aug. 3, 2017

(30) Foreign Application Priority Data

Feb. 1, 2016 (JP) ..... 2016-016995

(51) Int. Cl.
*G03G 15/16* (2006.01)

(52) U.S. Cl.
CPC ..... *G03G 15/1665* (2013.01)

(58) Field of Classification Search
CPC ..... G03G 15/1675; G03G 15/1605; G03G 15/1665; G03G 2215/0132; G03G 15/161
USPC ..... 399/66
See application file for complete search history.

(56) References Cited

U.S. PATENT DOCUMENTS 4,244,321 A * 1/1981 Plumadore ..... G03G 15/101 399/242
4,753,543 A * 6/1988 Mochimaru ..... G03G 15/2064 118/60

FOREIGN PATENT DOCUMENTS

JP 3517621 B2 4/2004
JP 2013-171282 A 9/2013

OTHER PUBLICATIONS

Translation of Tomoaki (JP 2013-171282 A) listed in the IDS, publication date: Sep. 2, 2013.*

* cited by examiner

*Primary Examiner* — Walter L Lindsay, Jr.
*Assistant Examiner* — Frederick Wenderoth
(74) *Attorney, Agent, or Firm* — Sughrue Mion, PLLC

(57) ABSTRACT

An image forming apparatus includes an image carrier that carries a toner image; a transfer part that is disposed so as to be in contact with the image carrier and transfers the toner image carried by the image carrier to a recording medium; and a charge applying part that is disposed on an upstream side of the transfer part in a recording-medium transport direction and charges the recording medium such that an amount of charge in the recording medium varies according to the position therein in a direction intersecting a recording-medium transport direction when the recording medium has reached the transfer part.

14 Claims, 6 Drawing Sheets

IMAGE FORMING APPARATUS

CROSS-REFERENCE TO RELATED APPLICATIONS

This application is based on and claims priority under 35 USC 119 from Japanese Patent Application No. 2016-016995 filed Feb. 1, 2016.

BACKGROUND

Technical Field

The present invention relates to image forming apparatuses.

SUMMARY

According to an aspect of the invention, there is provided an image forming apparatus including an image carrier that carries a toner image; a transfer part that is disposed so as to be in contact with the image carrier and transfers the toner image carried by the image carrier to a recording medium; and a charge applying part that is disposed on an upstream side of the transfer part in a recording-medium transport direction and charges the recording medium such that an amount of charge in the recording medium varies according to the position therein in a direction intersecting a recording-medium transport direction when the recording medium has reached the transfer part.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

First Exemplary Embodiment

Figure 1:
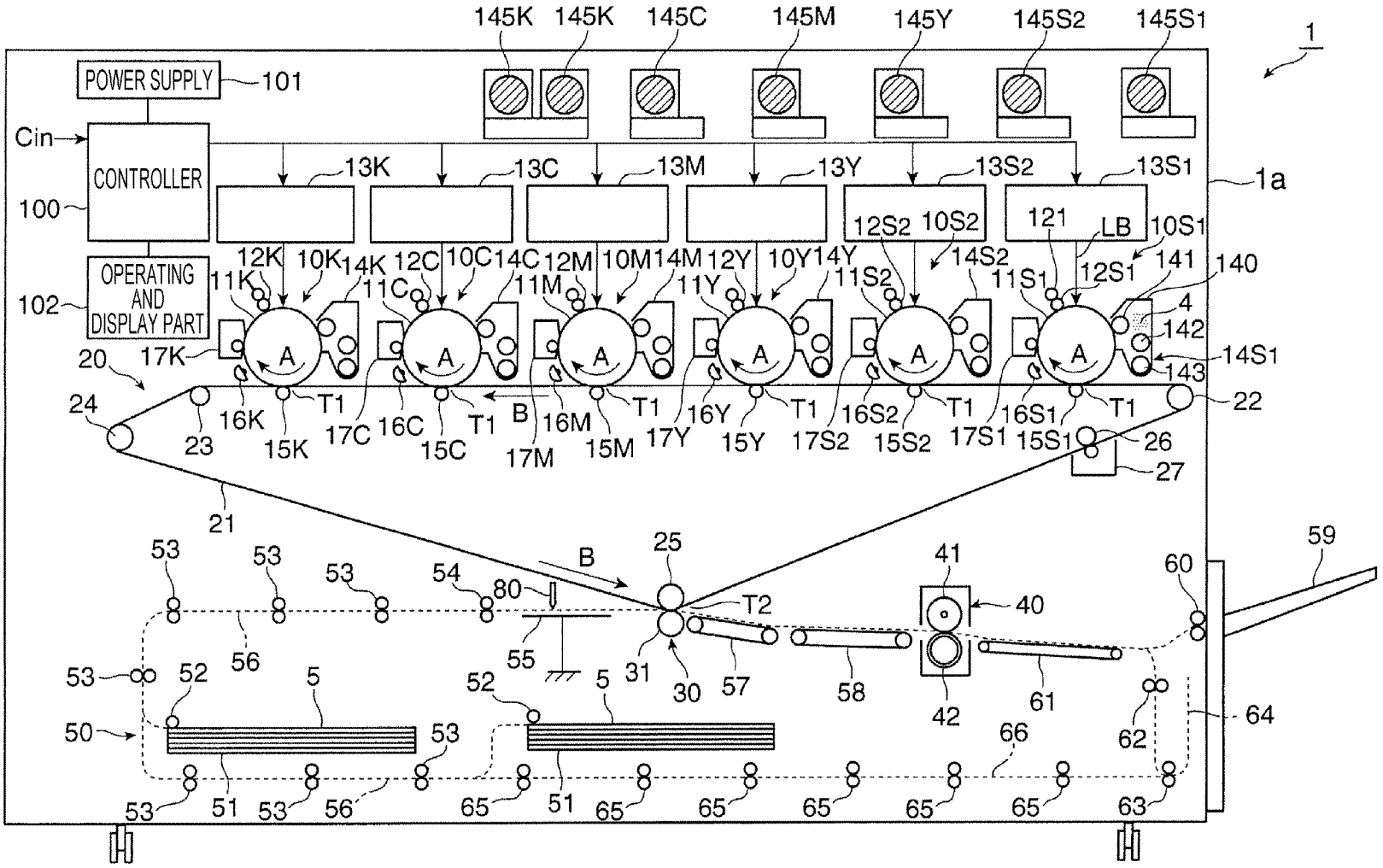
FIG. 1 shows the overall configuration of an image forming apparatus according to a first exemplary embodiment of the present invention.

FIG. 1 shows, in outline, the overall configuration of an image forming apparatus according to a first exemplary embodiment of the present invention.

Overall Configuration of Image Forming Apparatus

An image forming apparatus 1 according to the first exemplary embodiment is configured as, for example, a color printer. The image forming apparatus 1 includes image forming units 10, which form toner images developed with toner, serving as developer 4; an intermediate transfer device 20, which carries the toner images formed by the image forming units 10 and transports them to a second transfer position T2, where the toner images are second-transferred to a recording sheet 5, serving as an example of a recording medium; a paper feed device 50, which accommodates and transports recording sheets 5 to be fed to the second transfer position T2 of the intermediate transfer device 20; a fixing device 40, which fixes the toner images second-transferred to the recording sheet 5 by the intermediate transfer device 20; etc. Reference sign 1*a* in FIG. 1 denotes the body of the image forming apparatus 1, and the body 1*a* includes a support structure member, an outer covering, etc. Furthermore, a dashed line in FIG. 1 shows a major transport path in the body 1*a*, along which the recording sheet 5 is transported.

The image forming units 10 include six image forming units 10Y, 10M, 10C, 10K, 1051, and 10S2, serving as an example of five or more image forming units, which form toner images of four colors (yellow (Y), magenta (M), cyan (C), and black (K)) and toner images of two special colors S1 and S2, respectively. These six image forming units 10 (S1, S2, Y, M, C, and K) are arranged side-by-side in a line, inside the body 1*a*. The developers 4 of the special colors (S1 and S2) are composed of colorants or the like and enable expressions that have been difficult or impossible with the above-described four colors. The developers 4 of the special colors (S1 and S2) include a transparent (clear) toner for improving the gloss, a white toner for improving the whiteness of the recording sheet 5, a color toner that is not included in the aforementioned four color toners, and a color toner that is included in the aforementioned four colors but in a different saturation. In this exemplary embodiment, the image forming unit 1051 uses a transparent toner, and the image forming unit 1052 uses a white toner. The image forming units 10 (S1, S2, Y, M, C, and K) have the same configuration, as described below, except for the type of the developer 4 they use.

As shown in FIG. 1, the image forming units 10 (S1, S2, Y, M, C, and K) include rotatable photoconductor drums 11 (S1, S2, Y, M, C, and K), serving as an example of an image carrier. The photoconductor drums 11 (S1, S2, Y, M, C, and K) are surrounded by: charging devices 12 (S1, S2, Y, M, C, and K) for charging, to predetermined electric potentials, the circumferential surfaces (image carrying surfaces) of the photoconductor drums 11 (S1, S2, Y, M, C, and K) on which images can be formed; exposure devices 13 (S1, S2, Y, M, C, and K), which irradiate the charged circumferential surfaces of the photoconductor drums 11 (S1, S2, Y, M, C, and K) with light LB based on image information (signal) to form electrostatic latent images corresponding to the respective colors, which have potential differences; developing devices 14 (S1, S2, Y, M, C, and K), which develop the electrostatic latent images with the toners in the developers 4 of the corresponding colors (S1, S2, Y, M, C, and K) into toner images; first transfer devices 15 (S1, S2, Y, M, C, and K), serving as an example of a first transfer part, which transfer the toner images to the intermediate transfer device 20; erase lamps 16 (S1, S2, Y, M, C, and K), which remove the residual charges remaining on the image carrying surfaces of the photoconductor drums 11 (S1, S2, Y, M, C, and K) after the first transfer; drum cleaning devices 17 (S1, S2, Y, M, C, and K), which remove attached substances, such as toner, remaining on the image carrying surfaces of the photoconductor drums 11 (S1, S2, Y, M, C, and K) after the first transfer; etc.

The photoconductor drums 11 each include a grounded hollow or solid cylindrical base and an image carrying surface, which has a photoconductive layer (photosensitive layer) formed of a photosensitive material, formed on the circumferential surface thereof. The photoconductor drum 11 is supported so as to be rotatable in the direction indicated by an arrow A by receiving a motive force from a driving device (not shown).

The charging device 12 includes a contact-type charging roller, which is disposed so as to be in contact with the photoconductor drum 11. The charging device 12 includes a cleaning roller 121 for cleaning the surface thereof. The charging device 12 receives a charging voltage. If the developing device 14 performs reversal development, the charging voltage is a voltage or current having the same (negative) polarity as the charging polarity of the toner supplied by the developing device 14. Note that a non-contact charging device, such as scorotron, which is disposed so as not to be in contact with the surface of the photoconductor drum 11, may also be used as the charging device 12.

The exposure device 13 irradiates the charged circumferential surface of the photoconductor drum 11 with light LB (indicated by a solid line with an arrowhead), which is generated corresponding to the image information input to the image forming apparatus 1, to form an electrostatic latent image. The exposure devices 13 (S1, S2, Y, M, C, and K) correspond to the image forming units 10 for the special color S1, the special color S2, yellow (Y), magenta (M), cyan (C) and black (K). When latent images are to be formed, the exposure devices 13 receive, from the controller 100, image signals formed by performing predetermined image processing on full-color or black-and-white image information (signal) input to the image forming apparatus 1 through an arbitrary device. The exposure devices 13 may be formed of light-emitting-diode (LED) print heads, which form electrostatic latent images by irradiating the photoconductor drums 11 with light corresponding to the image information, using multiple LEDs, serving as light-emitting devices, arranged in the axial direction of the photoconductor drums 11 of the image forming units 10.

The developing devices 14 each include, inside a device housing 140 having an opening and a developer container chamber, a developing roller 141, serving as an example of a developer carrier, which carries and transports the developer 4 to a developing area where it faces the photoconductor drum 11; a supply-and-transport member 142, such as a screw auger, which supplies the developer 4 to the developing roller 141 while stirring; a stir-and-transport member 143, such as a screw auger, which stirs and transports the developer 4 while exchanging the developer 4 with the supply-and-transport member 142; and a layer-thickness restricting member (not shown), which restricts the amount (layer thickness) of developer 4 carried by the developing roller 141. The developers 4 of six colors (S1, S2, Y, M, C, and K) are, for example, two-component developers, each containing a nonmagnetic toner and a magnetic carrier.

The first transfer devices 15 are contact-type transfer devices, which are rotated while being in contact with the circumferences of the corresponding photoconductor drums 11, and which have first transfer rollers supplied with first transfer voltages. The first transfer voltages are direct-current voltages having the opposite polarity to the charging polarity of the toner and supplied from a power supply device (not shown).

The erase lamps 16 uniformly expose the surfaces of the photoconductor drums 11 to the light after the first transfer, thereby removing the residual charges on the surfaces of the photoconductor drums 11.

The drum cleaning devices 17 each include: a partially open container-shaped body; a cleaning plate disposed so as to be in contact with the circumferential surface of the photoconductor drum 11 after the first transfer at a predetermined pressure to remove attached substances, such as residual toner, to clean the photoconductor drum 11; and a delivery member, such as a screw auger, which recovers the attached substances, such as toner, removed by the cleaning plate and delivers the toner to a recovery system (not shown).

As shown in FIG. 1, the intermediate transfer device 20 is disposed below the image forming units 10 (S1, S2, Y, M, C, and K). The intermediate transfer device 20 is primarily formed of: an intermediate transfer belt 21, serving as an example of an image carrier (intermediate transfer body), which is rotated in a direction indicated by an arrow B, while passing through first transfer positions T1 between the photoconductor drums 11 and the first transfer devices 15 (first transfer rollers); multiple belt-support rollers 22 to 26, which support the intermediate transfer belt 21 from the inside in a desired state so as to be able to revolve; a second transfer device 30, serving as an example of a second transfer part, which is disposed on the outer circumferential surface (image carrying surface) of the intermediate transfer belt 21 supported by the belt-support roller 25 and second-transfers the toner images on the intermediate transfer belt 21 to a recording sheet 5; and a belt cleaning device 27, which removes attached substances, such as toner and paper dust, remaining on the outer circumferential surface of the intermediate transfer belt 21 after passing through the second transfer device 30 to clean the outer circumferential surface of the intermediate transfer belt 21.

The intermediate transfer belt 21 is an endless belt formed of a material composed of, for example, a synthetic resin, such as polyimide resin or polyamide resin, with a resistance adjusting agent, such as carbon black, dispersed therein. The belt-support roller 22 serves as a driving roller that is rotationally driven by a driving device (not shown), the belt-support roller 23 serves as a surface-forming roller that forms the image forming surface of the intermediate transfer belt 21, the belt-support roller 24 serves as a tension roller for applying tension to the intermediate transfer belt 21 and as a meandering correction roller for correcting meandering of the intermediate transfer belt 21, the belt-support roller 25 serves as a second-transfer back-support roller, and the belt-support roller 26 serves as an opposing roller for the belt cleaning device 27.

The second transfer device 30 is a contact-type transfer device having a second transfer roller 31, which constitutes a second transfer part and is rotated while being in contact with the circumferential surface of the intermediate transfer belt 21 at the second transfer position T2, which is a position on the outer circumferential surface of the intermediate transfer belt 21 supported by the belt-support roller 25, in the intermediate transfer device 20, and to which a second transfer voltage is supplied. The second transfer roller 31 is disposed so as to be in contact, at a predetermined pressure, with the belt support roller 25, which is fixed in position, with the intermediate transfer belt 21 therebetween. The second transfer device 30 includes the second transfer roller 31 and the belt support roller 25, serving as a back-support roller. A direct-current voltage serving as a second transfer voltage, which has the opposite polarity to or the same polarity as the charging polarity of the toner, is applied to the second transfer roller 31 or the belt-support roller 25. In this exemplary embodiment, as shown in FIG. 2B, a direct-current high voltage having the same (negative) polarity as the charging polarity of the toner is applied, as the second transfer voltage, to the belt-support roller 25 by a high-voltage power supply 253. The second transfer roller 31 is grounded.

Figure 2A:
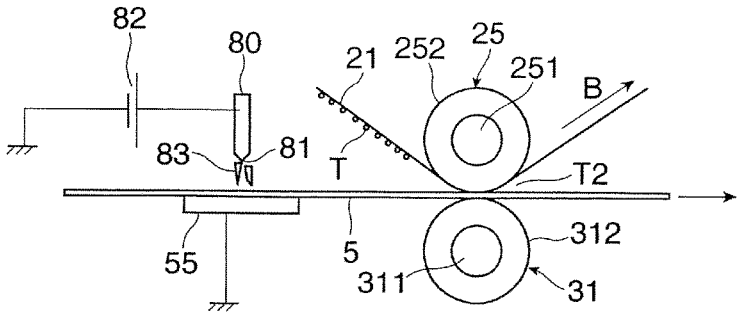
FIG. 2A shows a relevant part of the image forming apparatus according to the first exemplary embodiment of the present invention.
Figure 2B:
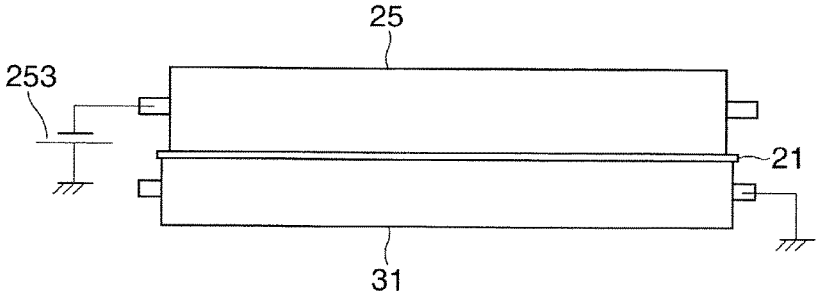
FIG. 2B shows a belt support roller and a second transfer roller in a contact state.

As shown in FIG. 2A, the second transfer roller 31 is formed in a cylindrical shape by covering the outer circumference of a metal core 311 with an elastic layer 312, which is formed of a synthetic resin with a resistance adjusting agent, such as carbon black or an ionic conductive agent, dispersed therein to adjust the resistance to a predetermined value. Similarly, the belt support roller 25 is formed in a cylindrical shape by covering the outer circumference of a metal core 251 with an elastic layer 252, which is formed of a synthetic resin with a resistance adjusting agent, such as carbon black or an ionic conductive agent, dispersed therein to adjust the resistance to a predetermined value. The second transfer roller 31 is urged against the surface of the belt support roller 25 at a predetermined pressure, with the intermediate transfer belt 21 therebetween. The belt support roller 25 is rotatably supported at a fixed position.

The belt cleaning device 27 has the same configuration as the drum cleaning devices 17 and includes a partially open container-shaped body, a cleaning plate (not shown) disposed so as to be in contact with the circumferential surface of the intermediate transfer belt 21 after the second transfer at a predetermined pressure to remove attached substances, such as residual toner, to clean the circumferential surface of the intermediate transfer belt 21, and a delivery member, such as a screw auger (not shown), which recovers the attached substances, such as toner, removed by the cleaning plate and delivers the toner to a recovery system.

The fixing device 40 includes a roller-shaped or belt-shaped heating rotary member 41, which is heated by a heating device such that the surface thereof is maintained at a predetermined temperature, and a roller-shaped or belt-shaped pressure-applying rotary member 42, which extends substantially parallel to the axial direction of the heating rotary member 41 and is rotated while being in contact with the heating rotary member 41 at a predetermined pressure. In the fixing device 40, a contact part where the heating rotary member 41 and the pressure-applying rotary member 42 are in contact with each other serves as a fixing part at which predetermined fixing processing (heating and pressing) is performed.

The paper feed device 50 is disposed below the intermediate transfer device 20. The paper feed device 50 is primarily formed of multiple (or a single) sheet containers 51 for accommodating a stack of recording sheets 5 of a desired size and type, and delivery devices 52 for picking up recording sheets 5 one-by-one from the sheet containers 51. The sheet containers 51 are attached such that they can be pulled toward, for example, the front side (i.e., the side to which a user faces when using the image forming apparatus 1) of the body 1*a*.

Examples of the recording sheet 5 include normal paper used in copiers and printers of an electrophotographic system, thin paper, such as tracing paper, and OHP sheets. For an even smoother image surface after fixing, it is preferable that the surface of the recording sheet 5 be as smooth as possible, and hence, for example, coated paper formed by coating the surface of normal paper with resin or the like, and so-called thick paper, such as art paper for printing, which has a relatively large grammage, may also be suitably used. Herein, recording sheets 5 having a grammage of less than 80 g/m$^2$ are classified as thin paper, recording sheets 5 having a grammage of greater than or equal to 80 g/m$^2$ to less than 100 g/m$^2$ are classified as normal paper, recording sheets 5 having a grammage of greater than or equal to 100 g/m$^2$ to less than 200 g/m$^2$ are classified as first thick paper, and recording sheets 5 having a grammage of greater than or equal to 200 g/m$^2$ are classified as second thick paper. Note that these grammage thresholds for distinguishing the thin paper, the normal paper, the first thick paper and the second thick paper from one another are merely examples and are not intended to be limiting. There is, of course, no need to divide the thick paper into the first and second thick papers, and they may be treated as a single type of thick paper.

A feed-and-transport path 56, which includes multiple (or single) sheet-transport roller pairs 53 and 54, a transport guide 55 for transporting the recording sheet 5 fed out of the paper feed device 50 to the second transfer position T2, and the like, is provided between the paper feed device 50 and the second transfer device 30. The sheet-transport roller pair 54 serves as, for example, rollers (registration rollers) for adjusting the timing of transporting the recording sheet 5 to the second transfer position T2. Furthermore, two transport belts 57 and 58, which transport the recording sheet 5 discharged from the second transfer roller 31 of the second transfer device 30 after the second transfer to the fixing device 40, are provided between the second transfer device 30 and the fixing device 40. In addition, a sheet output roller pair 60, which outputs the recording sheet 5 discharged from the fixing device 40 after fixing onto a sheet output part 59, provided on a side surface of the body 1*a*, is provided near the discharge port for the recording sheet 5 in the body 1*a*.

A transport belt 61 and a switching gate (not shown) for switching between the sheet transport paths are provided between the fixing device 40 and the sheet output roller pair 60. When images are to be formed on both sides of a recording sheet 5, the switching gate directs the recording sheet 5 having an image formed on one side thereof downward, temporarily transporting the recording sheet 5 to a reversing path 64, which has sheet-transport roller pairs 62 and 63. While the end of the recording sheet 5 is held by the sheet-transport roller pair 63, the transport direction is reversed such that the recording sheet 5 is transported from the reversing path 64, whereby the recording sheet 5 is reversed. The recording sheet 5 is then transported to the general feed-and-transport path 56 via a duplex-printing transport path 66, which includes multiple sheet-transport roller pairs 65, a transport guide (not shown), etc. Note that, when, after white toner is uniformly applied to a surface of a recording sheet 5, an image is to be formed on the same surface of the recording sheet 5, the recording sheet 5 is directly transported to the duplex-printing transport path 66 by the sheet-transport roller pairs 62, without being reversed.

In FIG. 1, reference signs 145 (S1, S2, Y, M, C, and K) denote toner cartridges that are arranged in the direction perpendicular to the plane of the sheet and store developer, which contains at least toner, to be supplied to the corresponding developing devices 14 (S1, S2, Y, M, C, and K).

Furthermore, reference sign 100 in FIG. 1 denotes a controller for controlling, in a centralized manner, the operation of the image forming apparatus 1. The controller 100 includes a central processing unit (CPU), a read-only memory (ROM), a random-access memory (RAM), a bus connecting the CPU, the ROM, etc. to one another, a communication interface, etc. (not shown). The controller 100 performs predetermined image processing on an image signal Cin, which is input from the outside, to convert the signal to image signals corresponding to the special color S1, the special color S2, yellow (Y), magenta (M), cyan (C) and black (K), as necessary, and then outputs these image signals to the corresponding exposure devices 13 (S1, S2, Y, M, C, and K) of the image forming units 10 of the special color S1, the special color S2, yellow (Y), magenta (M), cyan (C) and black (K).

Reference sign 101 denotes a power supply for supplying power to the controller 100 and the like, and reference sign 102 denotes an operating and display part via which a user operates the image forming apparatus 1. The operating and display part 102 includes a designating part (not shown), via which the user designates image formation condition, such as an image-formation mode and a recording sheet 5 to be used for image formation. In the operating and display part 102, various image-formation modes, such as a full-color mode, a monochrome mode, a gloss-adding mode, and a whiteness-adding mode, as well as the size and type (e.g., normal, thin, or thick paper) of the recording sheet 5 are designated. Alternatively, the controller 100 may be configured to automatically determine the size and type (e.g., normal, thin, or thick paper) of the recording sheet 5 according to a signal from identifying parts (not shown) provided on the sheet containers 51.

Operation of Image Forming Apparatus

A basic image forming operation performed by the image forming apparatus 1 will be described below.

Herein, first, an image-forming operation performed when forming a full-color image that is composed of toner images of four colors (Y, M, C, and K), using the four image forming units 10 (Y, M, C, and K), will be described.

When the image forming apparatus 1 receives an image-forming-operation (printing) request instruction information, the four image forming units 10 (Y, M, C, and K), the intermediate transfer device 20, the second transfer device 30, the fixing device 40, etc. are actuated.

In the image forming units 10 (Y, M, C, and K), first, the photoconductor drums 11 are rotated in the direction indicated by the arrow A, and the charging devices 12 charge the surfaces of the photoconductor drums 11 to a predetermined polarity (in the first exemplary embodiment, negative polarity) and predetermined electric potentials. Then, the exposure devices 13 irradiate the charged surfaces of the photoconductor drums 11 with light LB, which is emitted on the basis of the image signals obtained by converting the image information, input to the image forming apparatus 1, to the respective color components (Y, M, C, and K), thereby forming, on the surfaces thereof, electrostatic latent images corresponding to the respective color components and having predetermined potential differences.

Next, the developing devices 14 (Y, M, C, and K) develop the electrostatic latent images of the respective color components, which are formed on the photoconductor drums 11, by supplying, from the developing rollers 141, toners of the corresponding colors (Y, M, C, and K) charged to a predetermined (negative) polarity and making the toners electrostatically adhere thereto. As a result, the electrostatic latent images of the respective color components, formed on the photoconductor drums 11, become visible in the form of toner images of four colors (Y, M, C, and K) that have been developed with the toners of the corresponding colors.

Then, when the respective color toner images formed on the photoconductor drums 11 of the image forming units 10 (Y, M, C, and K) are transported to the first transfer positions T1, the first transfer devices 15 sequentially first-transfer, in a superimposed manner, the respective color toner images to the intermediate transfer belt 21 of the intermediate transfer device 20, which is running in the direction indicated by the arrow B.

Once the first transfer has been completed, in the respective image forming units 10, the erase lamps 16 remove the residual charges remaining on the surfaces of the photoconductor drums 11 after the first transfer, and the drum cleaning devices 17 scrape off the attached substances, thereby cleaning the surfaces of the photoconductor drums 11. By doing this, the image forming units 10 can be used for the subsequent image forming operation.

Next, in the intermediate transfer device 20, the first-transferred toner images are transported to the second transfer position T2 by the revolving intermediate transfer belt 21. Meanwhile, in the paper feed device 50, a recording sheet 5 is fed into the feed-and-transport path 56, in accordance with the image forming operation. In the feed-and-transport path 56, the sheet-transport roller pair 54, serving as the registration rollers, feeds the recording sheet 5 to the second transfer position T2, in accordance with the transfer timing.

At the second transfer position T2, the second transfer device 30 second-transfers the superimposed toner images on the intermediate transfer belt 21 to the recording sheet 5. After the second transfer, in the intermediate transfer device 20, the belt cleaning device 27 removes attached substances, such as residual toner, on the surface of the intermediate transfer belt 21.

The recording sheet 5 to which the toner image has been second-transferred is then separated from the intermediate transfer belt 21 and the second transfer roller 31 and is then transported to the fixing device 40 by the transport belts 57 and 58. The fixing device 40, by guiding the recording sheet 5 after the second transfer into the contact part between the rotating heating rotary member 41 and the pressure-applying rotary member 42 and making it pass therebetween, performs necessary fixing processing (heating and pressing), thereby fixing the unfixed toner image to the recording sheet 5. Finally, when image formation is performed only on one side, the recording sheet 5 after fixing is output onto the sheet output part 59, which is provided, for example, on the outside of the body 1*a*, by the sheet output roller pair 60.

Through the operation described above, the recording sheet 5 on which a full-color image that is composed of toner images of four colors is formed is output.

Next, an operation performed when toner images of the special colors, which are formed of the developers of the special colors S1 and S2, are also formed when, for example, the image forming apparatus 1 performs the above-described normal image formation, will be described.

In this case, first, the image forming units 1051 and 1052 perform the same image forming operation as that performed by the image forming units 10 (Y, M, C, and K). As a result, toner images of the special colors are formed on the photoconductor drums 11 of the image forming units 1051 and 1052. The toner images of the special colors, which are formed in the image forming units 1051 and 1052, are first-transferred to the intermediate transfer belt 21 of the intermediate transfer device 20, as in the image forming operations performed when toner images of four colors are formed, and are then second-transferred from the intermediate transfer belt 21 to the recording sheet 5 (together with the toner images of the other colors) by the second transfer device 30. Finally, the recording sheet 5, to which the toner images of the special colors and the toner images of the other colors have been second-transferred, is subjected to fixing processing in the fixing device 40 and is then output to the outside of the body 1*a*.

Through the operation described above, the recording sheet 5 having one or two special-color toner images superimposed on the entirety or a part of the full-color image that is composed of toner images of four colors is output.

Configuration of Characteristic Part of Image Forming Apparatus

In the image forming apparatus 1 configured as above, as shown in FIGS. 1 and 2, the recording sheet 5 is fed, via the transport guide 55, to the second transfer position T2 by the sheet-transport roller pair 54, and the toner image T on the intermediate transfer belt 21 is second-transferred to the recording sheet 5 by a second-transfer electric field formed between the second transfer roller 31 and the belt-support roller 25.

Figure 3:
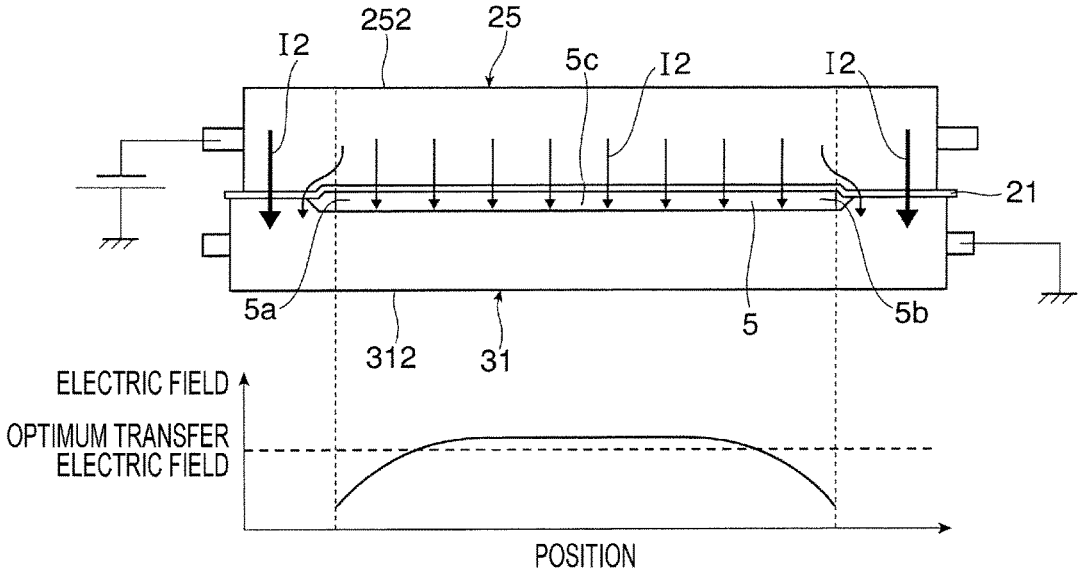
FIG. 3 shows a flow of a transfer electric current at the contact part between the belt support roller and the second transfer roller.

As shown in FIG. 3, at the second transfer position T2, the second transfer roller 31 is urged against the belt support roller 25, which supports the intermediate transfer belt 21 from the back surface side, with the intermediate transfer belt 21 and the recording sheet 5 therebetween. The second transfer roller 31 and the belt support roller 25 are formed of metal core members 311 and 251 and conductive elastic layers 312 and 252 formed on the outer circumferences thereof, respectively. Hence, in a sheet-passing area where the recording sheet 5 passes, the elastic layer 312 of the second transfer roller 31 and the elastic layer 252 of the belt support roller 25 are in contact with each other with the intermediate transfer belt 21 and the recording sheet 5 therebetween. In areas other than the sheet-passing area (i.e., non-sheet-passing areas), the elastic layer 312 of the second transfer roller 31 and the elastic layer 252 of the belt support roller 25 are in contact with each other with only the intermediate transfer belt 21 therebetween. Hence, in the non-sheet-passing areas, which are located on the outer sides of the ends 5*a* and 5*b* in the direction intersecting the sheet transport direction, the electrical resistance between the elastic layer 312 of the second transfer roller 31 and the elastic layer 252 of the belt support roller 25 is low due to the absence of the recording sheet 5, whereby a second-transfer electric current 12 easily flows. As a result, at the ends 5*a* and 5*b* of the recording sheet 5, which are close to the non-sheet-passing areas located at the ends in the direction intersecting the sheet transport direction, the second-transfer electric current 12 tends to detour around the ends 5*a* and 5*b* of the recording sheet 5 and preferentially flow into the areas where the elastic layers 312 and 252 are in contact with each other with only the intermediate transfer belt 21 therebetween. In this exemplary embodiment, a negative high voltage is applied to the belt support roller 25. Hence, the second-transfer electric current 12 flows from the second transfer roller 31 to the belt support roller 25. However, for convenience, the second-transfer electric current 12 is illustrated such that it flows from the belt support roller 25, to which a negative high voltage is applied, to the second transfer roller 31.

In contrast, at a middle part 5*c*, which is the part other than the ends 5*a* and 5*b* in the direction intersecting the sheet transport direction, the second-transfer electric current 12 flows stably through both the intermediate transfer belt 21 and the recording sheet 5. Hence, as shown in FIG. 3, at the middle part 5*c* of the recording sheet 5 in the direction intersecting the sheet transport direction, the second-transfer electric field is relatively high, whereas, at the ends 5*a* and 5*b*, because the second-transfer electric current 12 detours therearound, the second-transfer electric field is relatively low, and areas in which the optimum transfer electric field cannot be achieved are generated. This causes a difference in intensity of the image second-transferred to the recording sheet 5, between the ends 5*a* and 5*b* and the middle part 5*c* in the direction intersecting the sheet transport direction (more specifically, the intensity at both ends is low).

This image intensity difference generated in the direction intersecting the sheet transport direction tends to occur under the conditions in which the difference in the second-transfer electric field is more noticeable, that is, for example, when the recording sheet 5 is thick paper, which has a relatively large grammage, and when, in duplex-printing, an image is transferred to the back surface of a recording sheet 5 that has passed through the fixing device 40 and thus has lower moisture content and higher resistance.

In addition, when a predetermined number (for example, five) or more of toner images are transferred in a superimposed manner, such as when an image containing composite colors, such as blue, red, and green, which are obtained by mixing two or more of toners of yellow (Y), magenta (M), cyan (C), and black (K), is formed and when an image formed by further superimposing toners of the special colors S1 and S2, such as transparent toner and white toner, a relatively strong transfer electric field is needed to second-transfer the toner images to the recording sheet 5. Thus, the intensity difference tends to be noticeable according to the strength of the transfer electric field. Furthermore, when toner images of five or more colors are to be transferred to the recording sheet 5 in a superimposed manner, if a relatively strong transfer electric field is applied, the transfer electric field excessively acts on an area where a small number of toners are superimposed on one another, in the toner image to be transferred to the recording sheet 5, causing a discharge. As a result, compared with a case where a relatively weak transfer electric field is applied, image defects, such as a situation in which the toner charged to the opposite polarity due to the discharge is not transferred to the recording sheet 5, increase.

Furthermore, when a charge having the opposite polarity to the charging polarity of the toner is uniformly applied to the recording sheet 5 by the charge applying device, a second problem may occur at the middle part 5*c* in the direction intersecting the sheet transport direction, in which the transferability (transfer electric field) is already sufficient.

More specifically, as shown in FIG. 3, a sufficient optimum transfer electric field is already formed at the middle part 5*c* in the direction intersecting the sheet transport direction. Therefore, if a charge having the opposite polarity to the charging polarity of the toner is uniformly applied to the recording sheet 5 by the charge applying device, at the middle part 5*c* in the direction intersecting the sheet transport direction, an electric field that is newly formed by applying, to the surface of the recording sheet 5, a charge having the opposite polarity to the charging polarity of the toner is superimposed on the transfer electric field formed by the transfer voltage applied between the belt support roller 25 and the second transfer roller 31, and this excessive transfer electric field facilitates the occurrence of discharge. As a result, at the middle part 5*c* in the direction intersecting the sheet transport direction, part of toner is charged to the opposite polarity at the second transfer position T2, which may cause a decrease in intensity or a partial transfer defect.

To counter these problems, in this exemplary embodiment, a charge applying part is provided on the upstream side of the transfer part in the recording-medium transport direction. When a recording medium reaches the transfer part, the charge applying part charges the recording medium such that the amount of charge in the recording medium is varied according to the position in the direction intersecting the recording-medium transport direction.

In this exemplary embodiment, as shown in FIG. 2A, a charge applying device 80, serving as an example of a charge applying part, which applies a charge having the opposite (positive) polarity to the charging polarity of the toner, in the direction intersecting the sheet transport direction, is provided on the upstream side of the second transfer position T2 and on the downstream side of the sheet-transport roller pair 54 in the sheet transport direction. This charge applying device 80 is disposed at a position corresponding to the transport guide 55, on the downstream side of the sheet-transport roller pair 54 in the sheet transport direction.

Figure 2C:
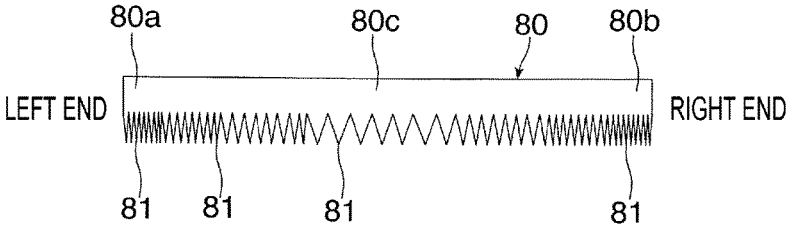
FIG. 2C shows a charge applying device.

As shown in FIG. 2C, the charge applying device 80 is a metal conductive plate that is formed of, for example, stainless steel or copper and is provided with needle electrodes 81 at an end (lower end) by etching, pressing, or cutting, the density of the needle electrodes 81 (i.e., the number of needle electrodes 81 per unit length) being gradually reduced from ends 80*a* and 80*b* toward a middle part 80*c* in the direction intersecting the sheet transport direction. As shown in FIG. 2A, a positive high voltage is applied to the charge applying device 80 by a high-voltage power supply 82.

Figure 2D:
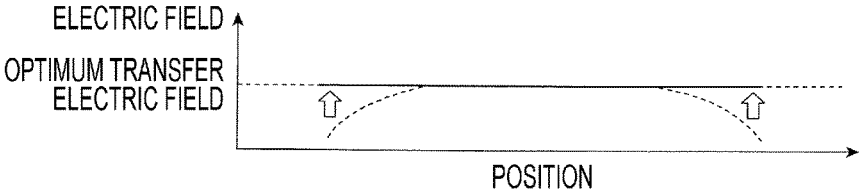
FIG. 2D is a graph showing the effect of the charge applying device.

As shown in FIG. 2A, as a result of a positive high voltage being supplied to the charge applying device 80 having the needle electrodes 81 by the high-voltage power supply 82, a discharge 83 is caused between the needle electrodes 81 of the charge applying device 80 and the grounded transport guide 55, and charged particles, such as ions, generated by the discharge 83 charge the recording sheet 5 passing below the charge applying device 80 to the opposite (positive) polarity to the charging polarity of the toner. The amount of charge applied to the recording sheet 5 by the charge applying device 80 is set to be relatively large at the left and right ends 80*a* and 80*b* in the direction intersecting the sheet transport direction, where the density of the needle electrodes 81 is relatively high, and is set to be relatively small at the middle part 80*c* in the direction intersecting the sheet transport direction, where the density of the needle electrodes 81 is relatively low. As a result, as shown in FIG. 2D, in the recording sheet 5, at the second transfer position T2, where the belt support roller 25 and the second transfer roller 31 face each other with the intermediate transfer belt 21 therebetween, the transfer electric field is increased by the transfer electric field applied between the belt support roller 25 and the second transfer roller 31 and a positive charge applied to the ends 5*a* and 5*b* in the direction intersecting the sheet transport direction by the charge applying device 80. Hence, a substantially uniform transfer electric field acts over the entire area in the direction intersecting the sheet transport direction.

Operation of Characteristic Part of Image Forming Apparatus

The operation of the characteristic part of the image forming apparatus 1 will be described below.

As shown in FIG. 1, in the image forming apparatus 1 according to this exemplary embodiment, the paper feed device 50 feeds a recording sheet 5 into the feed-and-transport path 56, in accordance with an image forming operation. In the feed-and-transport path 56, as shown in FIGS. 2A to 2D, the sheet-transport roller pair 54, serving as the registration rollers, supplies the recording sheet 5 to the second transfer position T2 via the transport guide 55, in accordance with the transfer timing of the toner image T supported on the intermediate transfer belt 21.

At this time, the controller 100 controls the timing of applying a positive high voltage to the charge applying device 80 via the high-voltage power supply 82. Although the controller 100 may be configured to cause the charge applying device 80 to apply a charge to the recording sheet 5 even when the recording sheet 5 is normal paper, the controller 100 is configured to cause the charge applying device 80 to apply a positive charge to the recording sheet 5 only when the recording sheet 5 is thick paper, in which a toner-image transfer defect tends to occur. In addition, the controller 100 is configured to cause, when images are to be formed on both sides of a recording sheet 5, the charge applying device 80 to apply a positive charge to the recording sheet 5 only when a toner image is transferred to the back surface (second surface) of the recording sheet 5.

In this case, when the controller 100 determines that the recording sheet 5 is first or second thick paper, which has a grammage of 100 g/m$^2$ or more, on the basis of a signal from the operating and display part 102, the controller 100, by controlling the high-voltage power supply 82, causes the charge applying device 80 to apply a positive charge to the recording sheet 5, which is thick paper. As a result, as shown in FIG. 2D, in the recording sheet 5, at the second transfer position T2, where the belt support roller 25 and the second transfer roller 31 face each other with the intermediate transfer belt 21 therebetween, the transfer electric field is increased by a positive charge applied to the ends 5*a* and 5*b* in the direction intersecting the transport direction by the charge applying device 80, forming a substantially uniform transfer electric field over the entire areas in the direction intersecting the sheet transport direction. Hence, it is possible to obtain a transfer image in which the intensity difference between the ends 5*a* and 5*b* and the middle part 5*c* in the direction intersecting the sheet transport direction is suppressed.

Figure 4A:
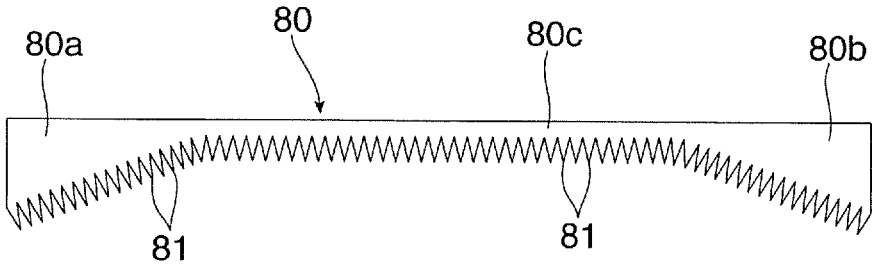
FIG. 4A shows the configuration of a modification of the charge applying device according to the first exemplary embodiment of the present invention.

Although a case where the charge applying device 80 having the needle electrodes 81 arranged in a non-uniform density is used has been described in the above-described exemplary embodiment, the charge applying device 80 is not limited thereto, and a charge applying device 80 configured as shown in FIG. 4A may also be used, in which the needle electrodes 81 are arranged in a uniform density in the longitudinal direction of the charge applying device 80, and the distance between the needle electrodes 81 and the transport guide 55 is gradually increased from the ends 5*a* and 5*b* toward the middle part 5*c* in the direction intersecting the sheet transport direction.

Figure 4B:
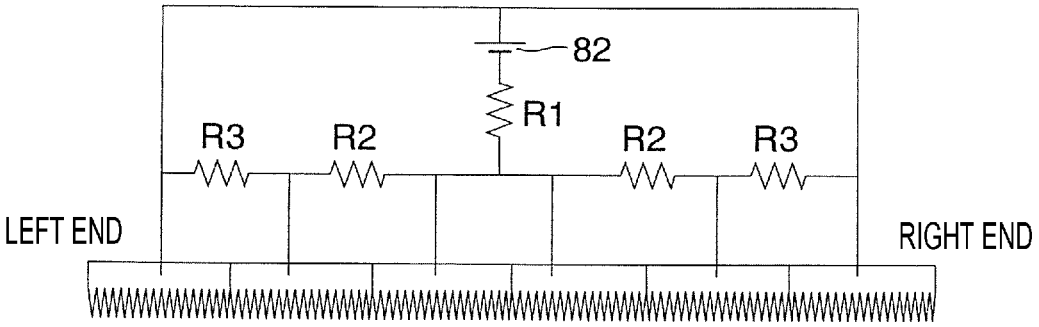
FIG. 4B shows the configuration of another example of the charge applying device.

Alternatively, the charge applying device 80 may be configured as shown in FIG. 4B, in which the needle electrodes 81 are provided in a uniform density in the longitudinal direction of the charge applying device 80, the distance between the needle electrodes 81 and the transport guide 55 is maintained constant, and multiple resistors R1, R2, and R3 are provided to apply a relatively high voltage to the needle electrodes 81 located at the ends 5*a* and 5*b* and a relatively low voltage to the needle electrodes 81 located at the middle part 5*c* in the direction intersecting the sheet transport direction. In this case, the configuration of the charge applying device 80 can be simplified.

Second Exemplary Embodiment

Figure 5:
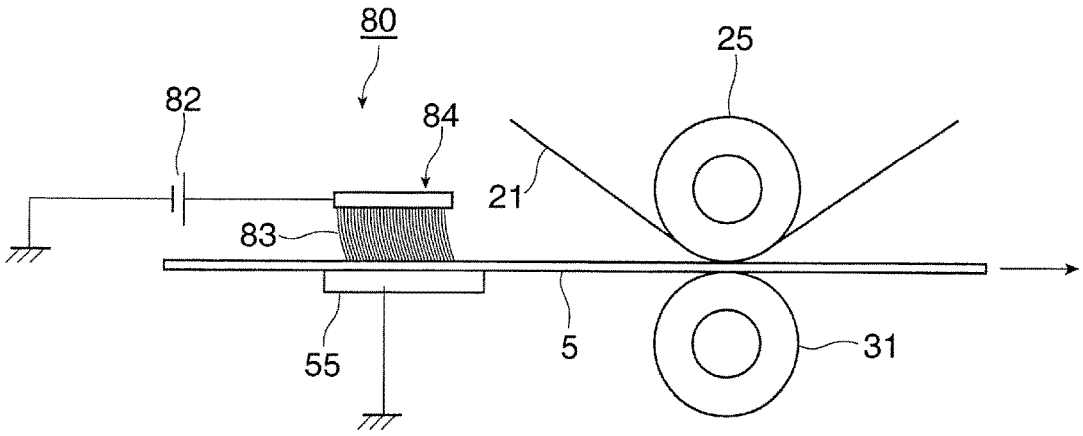
FIG. 5 shows the configuration of a charge applying device of an image forming apparatus according to a second exemplary embodiment of the present invention.

FIG. 5 shows the configuration of a charge applying device of an image forming apparatus according to a second exemplary embodiment of the present invention.

In the second exemplary embodiment, the charge applying device 80 does not have needle electrodes, but have a conductive brush 84, which is formed of densely implanted conductive fibers 83, as shown in FIG. 5.

This charge applying device 80 is configured to apply different charges to the ends 5*a* and 5*b* and to the middle part 5*c* in the direction intersecting the sheet transport direction, by varying, in the direction intersecting the sheet transport direction, the implant density of the conductive fibers 83 constituting the conductive brush 84. More specifically, the charge applying device 80 is configured such that the implant density of the conductive fibers 83 at the ends 5*a* and 5*b* in the direction intersecting the sheet transport direction is relatively high, and that at the middle part 5*c* in the direction intersecting the sheet transport direction is relatively low.

In this charge applying device 80, by varying the implant density of the conductive fibers 83, the amount of charge to be applied to the ends 5*a* and 5*b* and the middle part 5*c* in the direction intersecting the sheet transport direction can be easily adjusted.

Third Exemplary Embodiment

Figure 6:
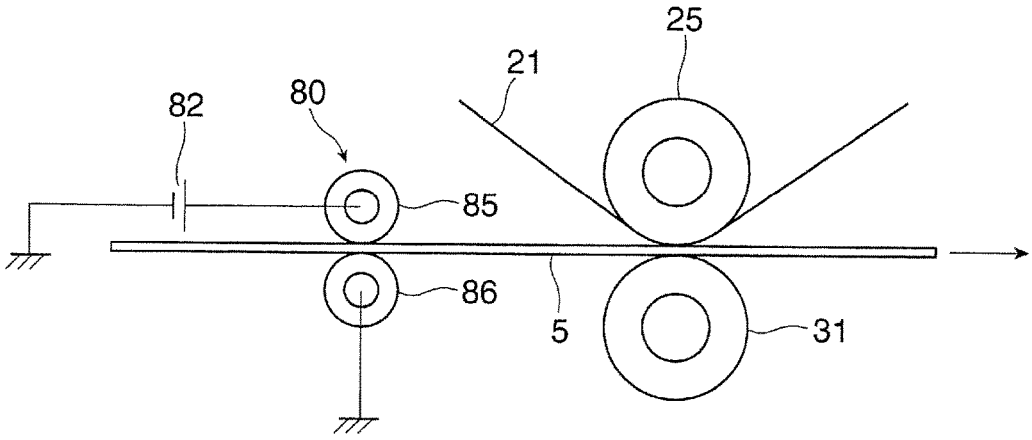
FIG. 6 shows the configuration of a charge applying device of an image forming apparatus according to a third exemplary embodiment of the present invention.

FIG. 6 shows the configuration of a charge applying device of an image forming apparatus according to a third exemplary embodiment of the present invention.

In the third exemplary embodiment, the charge applying device 80 does not have needle electrodes, but have a pair of conductive rollers 85 and 86, as shown in FIG. 6. The charge applying device 80 is configured such that the resistance, in the axial direction, of the conductive roller 85, which is disposed on the top surface side of a recording sheet 5, at the ends 5*a* and 5*b* in the direction intersecting the sheet transport direction is low, and that at the middle part 5*c* in the direction intersecting the sheet transport direction is high. The resistance of the conductive roller 85 can be adjusted by varying, in the axial direction, the amount of carbon black or ionic conductive agent to be added to synthetic resin constituting an elastic layer on the surface of the conductive roller. The conductive roller 86, which is disposed on the back surface side of the recording sheet 5, is grounded.

Fourth Exemplary Embodiment

Figure 7:
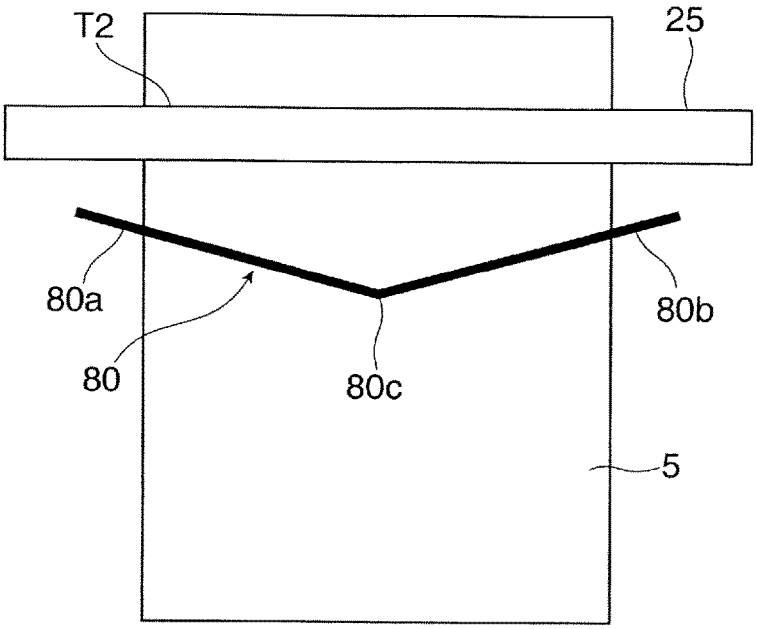
FIG. 7 shows the configuration of a charge applying device of an image forming apparatus according to a fourth exemplary embodiment of the present invention.

FIG. 7 shows the configuration of a charge applying device of an image forming apparatus according to a fourth exemplary embodiment of the present invention.

In this invention, it is only necessary that the charge applying part be configured to apply a charge to a recording medium such that the amount of charge carried by the recording medium varies according to the position therein in the direction intersecting the recording-medium transport direction when the recording medium has reached the transfer part.

In other words, the charge applying device 80 may apply a uniform amount of charge in the direction intersecting the sheet transport direction. It is only necessary that the ends 5*a* and 5*b* and the middle part 5*c*, which are positions in the direction intersecting the sheet transport direction, carry different amounts of charge when the recording sheet 5 has reached the second transfer position T2.

In the fourth exemplary embodiment, for example, the charge applying device 80 having the needle electrodes 81 that are arranged in a uniform density, as shown in FIG. 4B, is used. However, the charge applying device 80 has such a shape that portions between a center 80*c* and one end 80*a* and between the center 80*c* and another end 80*b* in the direction intersecting the sheet transport direction are inclined toward the second transfer position T2.

The charge applied to the surface of the recording sheet 5 by the charge applying device 80 is attenuated while the recording sheet 5 is transported to the second transfer position T2. In the fourth exemplary embodiment, the charge applying device 80 has such a shape that portions between the center 80*c* and the ends 80*a* and 80*b* are inclined toward the second transfer position T2. Hence, the ends 80*a* and 80*b* of the charge applying device 80 are relatively close to the second transfer position T2, and the center 80*c* of the charge applying device 80 is relatively far from the second transfer position T2. As mentioned above, the charge applied to the surface of the recording sheet 5 by the charge applying device 80 is attenuated while the recording sheet 5 is transported to the second transfer position T2. The charge applied to the ends 80*a* and 80*b* in the direction intersecting the sheet transport direction, which are close to the second transfer position T2, is less likely to be attenuated, whereas the charge applied to the center 80*c* in the direction intersecting the sheet transport direction, which is far from the second transfer position T2, is more likely to be attenuated. Hence, it is possible to vary the amount of charge eventually applied to the surface of the recording sheet 5 by the charge applying device 80, between the ends and the middle part in the direction intersecting the sheet transport direction.

Fifth Exemplary Embodiment

Figure 8:
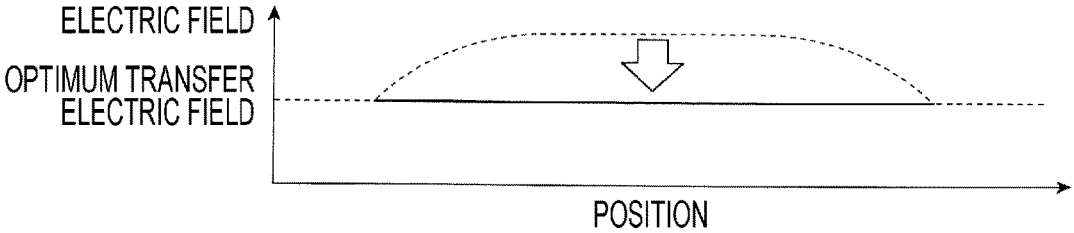
FIG. 8 is a graph showing the effect of a charge applying device of an image forming apparatus according to a fifth exemplary embodiment of the present invention.

FIG. 8 is a graph showing the effect of a charge applying device of an image forming apparatus according to a fifth exemplary embodiment of the present invention.

In the present invention, the polarity of the charge applied to the recording sheet 5 by the charge applying device 80 does not necessarily have to be positive, which is opposite to the charging polarity of the toner, but may be negative, which is the same as the charging polarity of the toner.

More specifically, in the fifth exemplary embodiment, as shown in FIG. 8, the polarity of the charge applied to the surface of the recording sheet 5 by the charge applying device 80 is negative, which is the same as the charging polarity of the toner. As shown by a dashed line in FIG. 8, in the transfer electric field formed by a voltage applied between the belt support roller 25 and the second transfer roller 31, because the negative high voltage applied to the belt support roller 25 is set higher than the voltage needed to form the optimum transfer electric field, the transfer electric field at the second transfer position T2 is different between the ends 5*a* and 5*b* and the middle part 5*c* in the direction intersecting the sheet transport direction.

Hence, in the fifth exemplary embodiment, the charge applying device 80 applies a negative charge, which has the same polarity as the charging polarity of the toner, to the middle part 5*c* in the direction intersecting the sheet transport direction, thereby reducing the transfer electric field acting on the middle part 5*c* of the recording sheet 5, compared with that acting on the ends 5*a* and 5*b*, and making total the second-transfer electric field acting on the recording sheet 5 at the second transfer position T2 substantially uniform in the direction intersecting the sheet transport direction.

Although the case where the image forming apparatus is a full-color image forming apparatus that includes multiple image forming units has been described in the above-described exemplary embodiments, the image forming apparatus may of course be a monochrome image forming apparatus that includes only one image forming unit.

Furthermore, although the case where the transfer part is a second transfer device that transfers a toner image from the intermediate transfer body to a recording medium has been described in the above-described exemplary embodiments, the transfer part may of course be a transfer device that transfers a toner image from a photoconductor to a recording medium.

Furthermore, although the image forming apparatus that has six photoconductor drums has been described in the above-described exemplary embodiments, the number of the photoconductor drums is not limited to six, but may be five or more, if more than one photoconductor drum is used. Alternatively, the image forming apparatus may be configured to have a single photoconductor drum. In the image forming apparatus having a single photoconductor drum, five or more toner images are sequentially formed on the single photoconductor drum, and the five or more toner image that are sequentially formed on the single photoconductor drum are directly transferred to a recording medium carried by a recording medium carrier, or are temporarily first-transferred to the intermediate transfer body and are then second-transferred to the recording medium.

Furthermore, although the case where the image forming units, each having an image carrier, are the six image forming units 10Y, 10M, 10C, 10K, 1051, and 10S2 for forming toner images of four colors (yellow (Y), magenta (M), cyan (C), and black (K)) and toner images of the two special colors S1 and S2, respectively, has been described in the above-described exemplary embodiments, the image forming units are not limited thereto, and it is only necessary that there be five or more image forming units for forming toner images of four colors (yellow (Y), magenta (M), cyan (C), and black (K)) and one toner image of the special color S1.

Furthermore, in the above-described exemplary embodiments, although it has been configured such that a direct-current high voltage having the same (negative) polarity as the charging polarity of the toner is applied to the belt support roller, and the second transfer roller is grounded, the configuration is not limited thereto, and it may also be configured such that a direct-current high voltage having the opposite (positive) polarity to the charging polarity of the toner is applied to the second transfer roller, and the belt support roller is grounded.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier configured to carry a toner image;

a transfer part that is disposed so as to be in contact with the image carrier and is configured to transfer the toner image carried by the image carrier to a recording medium; and a charge applying part that is disposed on an upstream side of the transfer part in a recording-medium transport direction and is configured to charge the recording medium such that an amount of charge is larger at left and right ends of the recording medium in a direction intersecting a recording-medium transport direction and an amount of charge is smaller at a middle part of the recording medium in the direction intersecting a recording-medium transport direction when the recording medium has reached the transfer part.

2. The image forming apparatus according to claim 1, wherein the charge applying part is configured to apply different amounts of charge to both ends and a middle part of the recording medium in the direction intersecting the recording-medium transport direction.

3. The image forming apparatus according to claim 1, wherein the charge applying part is configured to vary a position, in the recording-medium transport direction, where the charge is applied to the recording medium, according to the position in the direction intersecting the recording-medium transport direction, thereby varying the amount of charge attenuated after being applied to the recording medium and before reaching the transfer part.

4. The image forming apparatus according to claim 2, wherein the charge applying part is configured to vary the position, in the recording-medium transport direction, where the charge is applied to the recording medium, according to the position in the direction intersecting the recording-medium transport direction, thereby varying the amount of charge attenuated after being applied to the recording medium and before reaching the transfer part.

5. The image forming apparatus according to claim 1, comprising a single or five or more image carriers configured to carry five or more different toner images, wherein the charge applying part charges the recording medium when a predetermined number or more of the toner images are transferred from the single or five or more image carriers to the recording medium.

6. The image forming apparatus according to claim 2, comprising a single or five or more image carriers configured to carry five or more different toner images, wherein the charge applying part charges the recording medium when a predetermined number or more of the toner images are transferred from the single or five or more image carriers to the recording medium.

7. The image forming apparatus according to claim 3, comprising a single or five or more image carriers configured to carry five or more different toner images, wherein the charge applying part charges the recording medium when a predetermined number or more of the toner images are transferred from the single or five or more image carriers to the recording medium.

8. The image forming apparatus according to claim 1, wherein the charge applying part is configured to charge the recording medium only when thick paper is selected as the recording medium.

9. The image forming apparatus according to claim 2, wherein the charge applying part is configured to charge the recording medium only when thick paper is selected as the recording medium.

10. The image forming apparatus according to claim 3, wherein the charge applying part is configured to charge the recording medium only when thick paper is selected as the recording medium.

11. The image forming apparatus according to claim 1, further comprising:

a fixing part configured to fix the toner image transferred to the recording medium; and a duplex-printing transport part configured to reverse the recording medium having the toner image fixed by the fixing part and to feed the recording medium again to the transfer part, wherein the charge applying part is configured to charge the recording medium only when the toner image is transferred to a back surface of the recording medium.

12. The image forming apparatus according to claim 2, further comprising:

a fixing part configured to fix the toner image transferred to the recording medium; and a duplex-printing transport part configured to reverse the recording medium having the toner image fixed by the fixing part and to feed the recording medium again to the transfer part, wherein the charge applying part is configured to charge the recording medium only when the toner image is transferred to a back surface of the recording medium.

13. The image forming apparatus according to claim 3, further comprising:

a fixing part configured to fix the toner image transferred to the recording medium; and a duplex-printing transport part configured to reverse the recording medium having the toner image fixed by the fixing part and to feed the recording medium again to the transfer part, wherein the charge applying part is configured to charge the recording medium only when the toner image is transferred to a back surface of the recording medium.

14. An image forming apparatus comprising:

an image carrier configured to carry a toner image;

a transfer part that is disposed so as to be in contact with the image carrier and is configured to transfer the toner image carried by the image carrier to a recording medium; and a charge applying part that is disposed on an upstream side of the transfer part in a recording-medium transport direction and is configured to charge the recording medium such that an amount of charge in the recording medium varies according to a position in a direction intersecting a recording-medium transport direction when the recording medium has reached the transfer part, wherein the charge applying part is configured to charge the recording medium only when the toner image is transferred to a back surface of the recording medium.

* * * * *